United States Patent [19]

Comolli

[11] Patent Number: 5,045,180

[45] Date of Patent: Sep. 3, 1991

[54] CATALYTIC TWO-STAGE COAL LIQUEFACTION PROCESS HAVING IMPROVED NITROGEN REMOVAL

[75] Inventor: Alfred G. Comolli, Yardley, Pa.

[73] Assignee: HRI, Inc., Princeton, N.J.

[21] Appl. No.: 509,126

[22] Filed: Apr. 16, 1990

[51] Int. Cl.[5] ..... C10G 1/00

[52] U.S. Cl. ..... 208/413; 208/417; 208/418; 208/409

[58] Field of Search ..... 208/413, 417, 419

[56] References Cited

U.S. PATENT DOCUMENTS

| | | | |
|---|---|---|---|
| 3,594,305 | 7/1971 | Kirk, Jr. | 208/413 |
| 3,679,573 | 7/1922 | Johnson | 208/413 |
| 3,700,584 | 10/1972 | Johanson et al. | 208/413 |
| 4,018,663 | 4/1977 | Karr, Jr. | 208/413 |
| 4,110,192 | 8/1978 | Hildebrand et al. | 208/413 |
| 4,376,037 | 3/1983 | Duhlberg et al. | 208/413 |
| 4,816,141 | 3/1989 | McLean et al. | 208/413 |
| 4,842,719 | 6/1989 | MacArthur | 208/413 |
| 4,874,506 | 10/1989 | MacArthur | 208/413 |
| 4,879,021 | 11/1989 | Hippo et al. | 208/413 |

FOREIGN PATENT DOCUMENTS

| | | | |
|---|---|---|---|
| 3613445 | 10/1986 | Fed. Rep. of Germany | 208/413 |

*Primary Examiner*—Helane E. Myers

*Attorney, Agent, or Firm*—Fred A. Wilson

[57] ABSTRACT

A process for catalytic multi-stage hydrogenation and liquefaction of coal to produce high yields of low-boiling hydrocarbon liquids containing low concentrations of nitogen compounds. First stage catalytic reaction conditions are 700°-800° F. temperature, 1500-3500 psig hydrogen partial pressure, with the space velocity maintained in a critical range of 10-40 lb coal/hr $ft^3$ catalyst settled volume. The first stage catalyst has 0.3-1.2 cc/gm total pore volume with at least 25% of the pore volume in pores having diameters of 200-2000 Angstroms. Second stage reaction conditions are 760°-870° F. temperature with space velocity exceeding that in the first stage reactor, so as to achieve increased hydrogenation yield of low-boiling hydrocarbon liquid products having at least 75% removal of nitrogen compounds from the coal-derived liquid products.

10 Claims, 2 Drawing Sheets

NITROGEN REMOVAL FROM COAL LIQUIDS AT LOW SPACE VELOCITIES ON SUB-BITUMINOUS COAL

CATALYTIC TWO-STAGE COAL LIQUEFACTION PROCESS HAVING IMPROVED NITROGEN REMOVAL

The U.S. Government has rights in this invention pursuant to U.S. Department of Energy Contract No. DE-AC22-88PC88818.

BACKGROUND OF INVENTION

This invention pertains to a catalytic two-stage coal hydrogenation and liquefaction process for producing hydrocarbon liquid products having low nitrogen content, and in which the first stage catalytic reaction utilizes low coal space velocity which is significantly less than that for the second stage catalytic reaction.

Catalytic two-stage hydrogenation and liquefaction of coal to produce hydrocarbon liquid products is known, such as disclosed by U.S. Pat. Nos. 3,679,573 and 3,700,584 to Johnson; U.S. Pat. No. 4,111,788 to Chervenak et al; U.S. Pat. No. 4,842,719 and U.S. Pat. No. 4,874,506 to MacArthur, et al; and U.S. Pat. No. 4,816,141 to McLean et al. Although these processes provide high percentage conversion of both bituminous and sub-bituminous coals to produce low-boiling hydrocarbon liquid products, they provide only limited removal of undesired nitrogen compounds from the coal-derived liquid products. Such removal of nitrogen compounds from coal-derived liquids is quite desirable for environmental reasons. For known coal liquefaction processes, the conventional understanding has been that oxygen and sulfur are more susceptible for removal from the coal feed and liquid products than nitrogen. It has been theorized that the nitrogen in coal is tightly bound as pyridine, anilene and pyrollic compounds, and cannot be readily removed by known processes, whereas the oxygen in coal is removed as phenols, hydroxyls and ethers and the sulfur is removed as sulfoxides, thiophene and thiolether which can be readily treated.

Such problems with nitrogen removal from coal during liquefaction have now been substantially overcome by the present invention. It has now been unexpectedly discovered that removal of nitrogen compounds from coal and coal-derived liquid products is enhanced by use of critical low space velocity reaction temperature and catalyst characteristics in the first stage reactor of a multi-stage coal liquefaction process, as provided by a larger volume for the catalytic first stage reactor as compared to the second stage reactor.

SUMMARY OF INVENTION

This invention provides a catalytic multistage coal hydrogenation and liquefaction process for producing high yields of low-boiling hydrocarbon liquid products and providing enhanced removal of nitrogen compounds from the coal-derived liquid products. Coal feeds useful for this process should contain at least about 0.5 wt % nitrogen and usually contains 0.7–3.0 wt % nitrogen, and may be bituminous coal such as Illinois No. 6 or Kentucky No. 11; sub-bituminous coal such as Wyodak, or lignite. The coal feed is usually mixed with a coal-derived slurrying oil derived from the process and having a normal boiling range of 500°–1050° F., with at least about 50% of the slurrying oil preferably having a normal boiling temperature above about 850° F. Also, suitable slurrying oil for the coal feed may be selected from the group consisting of petroleum-derived residual oil, shale oil, tar sand bitumen, and oil derived from coal from another coal liquefaction process.

The coal-oil slurry is fed into the first stage catalytic reaction zone which is maintained at selected temperature and pressure conditions and having a bed of particulate hydrogenation catalyst, which promotes controlled liquefaction rate for the coal while simultaneously hydrogenating recycled hydrocarbon solvent oils at conditions which favor such hydrogenation and denitrogenation reactions at temperatures usually less than about 800° F. The first stage reaction zone contains an ebullated-bed of particulate hydrogenation catalyst to hydrogenate the particulate feed coal, solvent oil and dissolved coal molecules and produce desired low-boiling hydrocarbon liquid and gaseous materials.

In order to achieve the improved coal hydrogenation and enhanced denitrogenation of the coal-derived liquid products, the first stage catalytic reactor is operated at conditions of 700°–800° F. temperature, 1500–3500 psig hydrogen partial pressure and low space velocity within a critical range of 10–40 lb coal/hr $ft^3$ catalyst settled volume. Also, the catalyst used in the first stage reactor should be a hydrogenation catalyst having total pore volume of 0.3–1.2 cc/gm, with at least about 25% of the pore volume provided in pores having diameters greater than 150 Angstroms. Preferred first stage reaction conditions are 720°–780° F. temperature, 2000–3000 psig hydrogen partial pressure, and space velocity of 15–35 lb/hr $ft^3$ catalyst settled volume. The first stage catalyst should preferably have 0.4–1.0 cc/gm total pore volume, with 30–50% of that volume being contained in pores having diameter of 200–2000 Angstroms.

The total effluent from the first stage reactor is passed with additional hydrogen to a second stage reactor operated at conditions of 760°–870° F. temperature, 1500–3500 psig hydrogen partial pressure, and at increased space velocity of 15–80 lb coal/hr $ft^3$ catalyst settled volume. Preferred second stage reaction conditions are 800°–850° F. temperature, 2000–3000 psig hydrogen partial pressure and space velocity of 20–70 lb coal/hr $ft^3$ catalyst settled volume. The second stage reactor volume need be only about 0.3–0.9 that for the first stage catalytic reactor so that the space velocity in the second stage reactor is at least 10% greater than that in the first stage reactor.

The catalyst used in each reactor is selected from the group consisting of oxides of cobalt, iron, molybdenum, nickel, tin, tungsten and other hydrocarbon hydrogenation catalyst metal oxides known in the art, deposited on a base material selected from the group consisting of alumina, magnesia, silica, titania and similar materials. Useful catalyst particle sizes are within a range from 0.030 to 0.125 inch effective diameter. The first stage reactor catalyst pore volume should preferably be 0.4–1.00 cc/gm and have 30–50% of its pores having diameters of 200–2000 Angstroms.

In the second stage catalytic reaction zone, the material is further hydrogenated and hydrocracked at a temperature at least about 30° F. higher than for the first stage reaction zone and also at a higher space velocity. Both stage reaction zones are upflow, well mixed ebullated-bed catalytic reactors, with the second stage reaction zone being preferably close-coupled to the first stage reaction zone; however, gaseous material can be withdrawn interstage if desired. For the second stage reactor, the reaction conditions are maintained at higher severity which promotes more complete thermal conversion of the coal to liquids, hydroconversion of primary liquids to distillate products, and product quality improvement via heteroatoms removal at temperature greater than about 780° F. and hydrogen partial pressure similar to the first stage reaction zone. The second stage reaction conditions are selected to achieve at least about 90W % conversion of the remaining reactive coal along with the asphaltene and preasphaltene compounds to lower boiling hydrocarbon materials, and the heteroatoms are further reduced to provide tetrahydrofuran (THF) soluble materials. The second stage reactor space velocity is adjusted to achieve substantially complete conversion of the 650° F.+ heavy oils and residuum to 650° F.− liquid products, and also to achieve a low nitrogen content in the coal-derived hydrocarbon liquid product that is less than as produced by at least about 75 wt % denitrofication, and preferably 80–100 wt % denitrogenation.

The process preferably utilizes a first stage reactor having catalyst settled volume which is 1.1–3 times that of the second stage reactor. Each reactor contains an ebullated bed of particulate catalyst, such as a nickel molybdenum promoted aluminum-oxide supported catalyst. Coals for which this invention is useful include bituminous and sub-bituminous coals. Coal feed used for an experimental run was sub-bituminous Wyoming Black Thunder coal, in which the enhanced nitrogen removal result was first discovered. The initial results of a previous experiment made with bituminous Illinois #6 coal shows improved removal of nitrogen, in which the first stage reactor volume is twice that of the second stage reactor, which provides for the lower space velocity and increased reaction time for hydrogenation of the coal feed in the first stage catalytic reactor.

This two-stage catalytic coal liquefaction process provides high selectivity to low-boiling hydrocarbon liquid products and desired low yields of $C_1$–$C_3$ hydrocarbon gases and residuum materials, together with enhanced denitrogenation of the hydrocarbon liquid products. Although the present catalytic two-stage hydrogenation process produces high yields of distillate and lower molecular weight hydrocarbon products, it may be desirable for some coal feed materials or products to utilize a third stage catalytic reactor. The present multi-staged coal liquefaction process advantageously provides a significant improvement over prior two-stage coal liquefaction processes, by providing at least 75 wt % removal of nitrogen compounds from the coal-derived hydrocarbon liquid products, and preferably 80–100 wt % denitrogenation of the coal feed. The reaction conditions are selected to provide controlled hydrogenation and hydroconversion of the coal to produce mainly low-boiling liquid products, while simultaneously hydrogenating the recycle and coal-derived product oils, and producing hydrocarbon liquid products containing significantly lower concentrations of nitrogen compounds.

BRIEF DESCRIPTION OF DRAWINGS

The invention will be described further with reference to the following drawings, in which.

DESCRIPTION OF INVENTION

Figure 1:
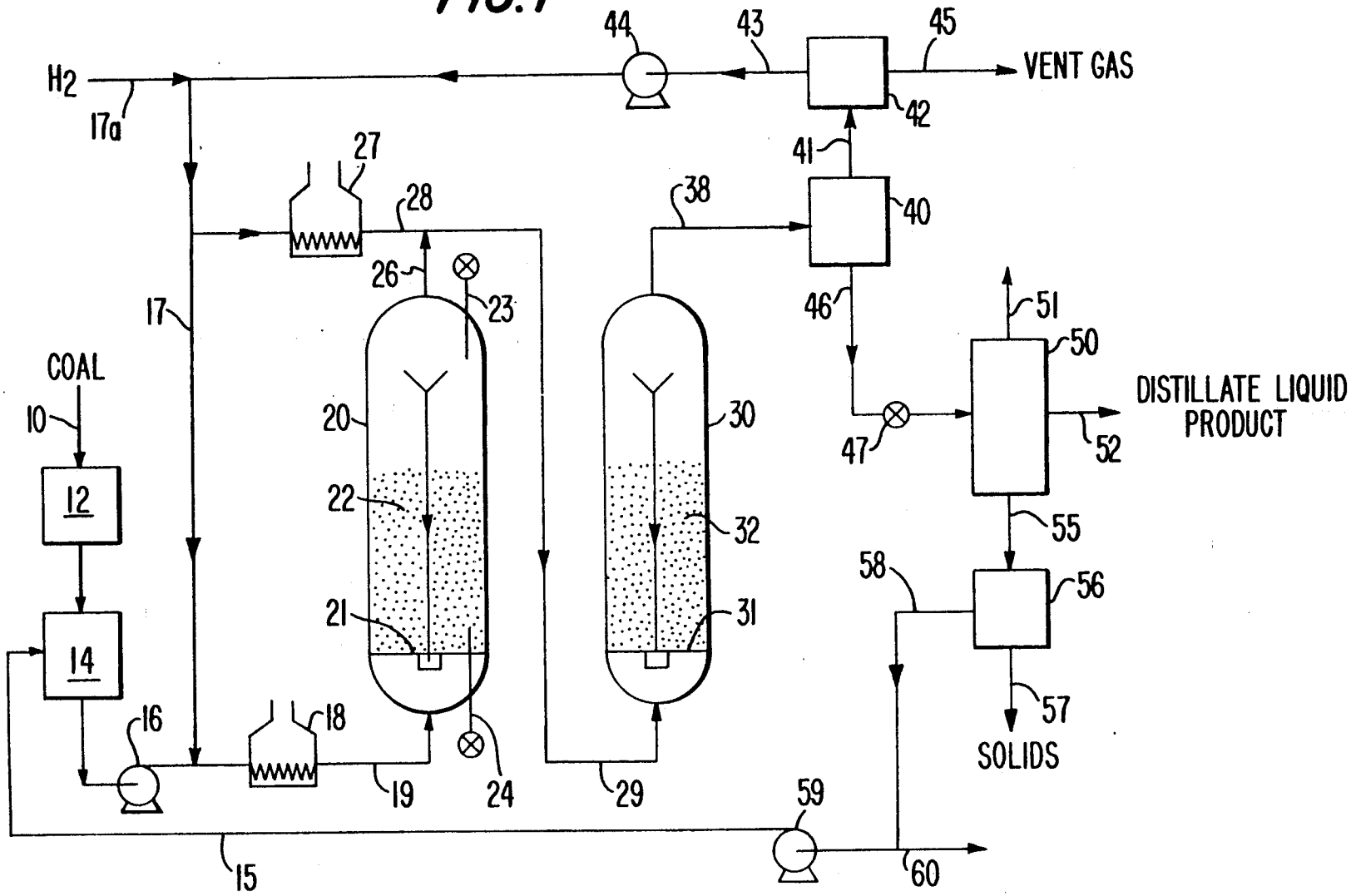
FIG. 1 is a schematic flow diagram of a catalytic two-stage coal hydrogenation and liquefaction process which provides enhanced nitrogen removal in accordance with the invention.

In the present invention, high yields of low-boiling hydrocarbon liquid products having low nitrogen content are produced from coal by a two-stage catalytic process using two well-mixed ebullated bed catalytic reactors direct-connected in series. As is shown in FIG. 1, coal such as bituminous, sub-bituminous or lignite is provided at 10 and passed through a coal preparation unit 12, where the coal is ground to a desired particle size range such as 50–375 mesh (U.S. Sieve Series) and dried to a desired moisture content such as 3–10W % moisture. The particulate coal is then slurried at tank 14 with sufficient process-derived recycle solvent liquid 15 having a normal boiling temperature above about 550° F. to provide a flowable slurry. The weight ratio of solvent oil/coal is usually in a range of 1.0–5.0, with a range of 1.3–3.0 being preferred. The coal-oil slurry is pressurized at pump 16, mixed with hydrogen at 17, preheated at heater 18 to 600°–650° F. temperature, and is then fed into the lower end of first stage back-mixed catalytic ebullated bed reactor 20. Fresh high-purity make-up hydrogen is provided as needed a 17*a*.

The coal-oil slurry and hydrogen enter reactor 20 containing ebullated catalyst bed 22, passing uniformly upwardly through flow distributor 21 at a flow rate and at temperature and pressure conditions to accomplish the desired hydrogenation and denitrogenation reactions therein. The operation of the ebullated bed catalytic reactor including internal recycle of reactor liquid upwardly through the expanded catalyst bed at recycle ratio exceeding about 2:1 is generally well known and is described by U.S. Pat. No. 4,439,933 which is incorporated herein by reference. The first stage reactor 20 preferably contains a particulate hydrogenation catalyst such as cobalt molybdate, nickel molybdate, or nickel tungsten on an alumina or silica support material, for which the total pore volume of 0.3–1.2 cc/gm has at least 25% provided in pores having diameter of 200–2000 Angstroms. In addition, fresh particulate hydrogenation catalyst may be added to reactor 20 at connection 23 in the ratio of about 0.1 to 2.0 pounds of catalyst per ton of coal processed. Spent catalyst may be removed from reactor 20 at connection 24 to maintain the desired catalytic activity within the reactor.

Operating conditions in the first stage reactor are maintained at moderate temperature range of 700°–800° F., 1500–3500 psig hydrogen partial pressure, and coal feed rate or space velocity of 10–40 lb coal/hr/ft$^3$ catalyst settled volume in the reactor, which is roughly equivalent to about 5–20 lb/hr ft$^3$ reactor volume. The preferred reaction conditions of 720°–780° F. temperature, 2000–3000 psig hydrogen partial pressure and 15–35 lb coal/hr/ft$^3$ catalyst settled volume will be specific to the particular coal being processed, because different coals convert to liquids under thermal conditions at different rates. The optimal first stage reaction conditions will allow maximum utilization of hydrogen shuttling solvent compounds, such as pyrene/hydropyrenes, known to be present in coal-derived recycled oils, since catalytic rehydrogenation of donor species occurs simultaneously with solvent-to-coal hydrogen transfer, while simultaneously hydrogenating the nitrogen-containing compounds. The coal-derived oils are also exposed to an efficient catalytic hydrogenation atmosphere immediately upon their formation, reducing the tendency for regressive repolymerization reactions which lead to poor quality hydrocarbon liquid products. First stage reactor thermal severity and space velocity not exceeding about 40 lb coal/hr/ft$^3$ catalyst settled volume is quite important, as too high a severity causes a coal conversion rate which is too rapid for the catalytic hydrogenation reactions to keep pace, as well as poorer hydrogenation equilibrium for the solvent compounds Too low a thermal severity in the first stage, while still providing an efficient atmosphere for solvent hydrogenation, does not provide desired coal conversion hydrocarbon liquid products.

In the first stage reactor, the objective is to hydrogenate the aromatic rings in molecules of the feed coal, recycle solvent and dissolved coal so as to produce in-situ a high quality hydrogen donor solvent liquid in the presence of hydrogen and the hydrogenation catalyst. At the moderate catalytic reaction conditions used, heteroatoms are removed, nitrogen containing compounds are reduced, retrogressive or coke forming reactions are essentially eliminated, and hydrocarbon gas formations are effectively minimized. Because of the reaction conditions used, i.e., relatively low first stage temperature and space velocity, the catalyst promotes coal hydrogenation, minimizes polymerization and cracking reactions, and enhances denitrogenation reactions. Also because of the reaction conditions in the first stage reactor, less coke is deposited on the catalyst at the milder reaction conditions, which minimizes catalyst deactivation and appreciably prolongs the effective life of the catalyst.

From the first stage reactor 20, the total effluent material 26 is mixed with additional hydrogen preheated at 27 and flows directly to the lower end of close-coupled second stage catalytic reactor 30 but at increased space velocities. This reactor 30 which operates similarly to reactor 20 contains flow distributor grid 31 and catalyst bed 32, and is operated at a temperature at least about 25° F. higher than for the first stage reactor, and usually in the temperature range of 760°-870° F. The higher temperature used in reactor 30 may be accomplished by utilization of the preheated hydrogen stream 28 as well as the second stage reactor heat of reaction. The second stage reactor pressure is slightly lower than for the first stage reactor to permit forward flow of the coal slurry material without any need for pumping, and additional makeup hydrogen is added at 28 to the second stage reactor as needed. A particulate catalyst similar to that used in the first stage reactor is utilized in bed 32 for the second stage reactor.

In the second stage reactor 30, the reaction conditions are selected to provide a more complete catalytic conversion of the unconverted coal to liquids, utilizing the high quality-solvent liquid produced in the first stage reactor. The remaining reactive coal as well as preasphaltenes and asphaltenes are converted to distillate liquid products along with additional heteroatoms removal. Substantial secondary conversion of coal derived liquids to distillate products, and product upgrading by heteroatoms removal, is also accomplished in the second stage reactor. The reaction conditions are selected to minimize gas formation or dehydrogenation of the first stage liquid effluent materials. Useful reactor conditions are 750°-875° F. temperature, 1500-3500 psig hydrogen partial pressure, and coal space velocity of 15-80 lb coal/hr/ft$^3$ catalyst settled volume, which is roughly equivalent to 7-40 lb coal/hr/ft$^3$ reactor volume. Preferred reaction conditions will depend on the particular type coal being processed, and are usually 800°-860° F. temperature, 2000-3000 psig hydrogen partial pressure, and space velocity of 20-70 lb coal/hr/ft$^3$ catalyst settled volume.

It is a characteristic of this process that little change in the hydrocarbon compounds composition occurs between the first and second stage reactions. Recycle of residual oil greatly enhances hydrogenation and hydroconversion of the coal in the first stage reactor.

From the second stage reactor 30, the effluent material at 38 is passed to a phase separator 40 operating at near reactor conditions, wherein a vapor fraction 41 is separated from a solids-containing liquid slurry fraction at 46. The vapor fraction 41 is treated at hydrogen purification section 42, from which hydrogen stream 43 is withdrawn for recycle by compressor 44 to the reactors 20 and 30. Fresh make-up hydrogen is added as needed at 17*a*. A vent gas containing undesired nitrogen and sulfur compounds is removed from purification section 42 as stream 45.

The slurry liquid fraction 46 is pressure-reduced at 47 to near atmospheric pressure, such as about 200 psig, and passed to a distillation system generally shown at 50. The resulting liquid fractions are recovered by a vapor/liquid flash in distillation system 50, including atmospheric and vacuum distillation steps to produce light distillate product stream 51 and a heavier higher-boiling distillate liquid product stream 52. A bottoms stream 55 is passed to a liquid-solids separation step 56, from which unconverted coal and ash solids are removed at 57. The liquid stream 58 containing reduced concentration of solids is recycled by pump 59 as the slurring oil 15. If desired, a reduced solids concentration product liquid stream can be withdrawn at 60.

The recycle slurrying oil stream 58 is prepared by blending a portion of the atmospheric separator bottoms liquid slurry (containing 500° F.+ distillate, residuum, unreacted coal and ash), the atmospheric fractionation bottoms material (600° F.+ distillate), and vacuum gas oil. This slurrying liquid at 58 is then recycled as stream 15 back to the mixing step at 14, where it is mixed with the coal feed to form the flowable slurry feedstream to the first stage reactor 20.

The recycle oil preparation in liquid-solids separation step 56 can be improved by reducing its solids concentration (ash and unconverted coal) by using known solids removal means in separation step 56, such as by use of hydroclones, centrifuges, filters or solvent deashing techniques.

This invention will be further described and better understood by reference to the following Examples of comparative operations, which Examples would not be construed as limiting the scope of the invention.

EXAMPLE 1

Figure 2:
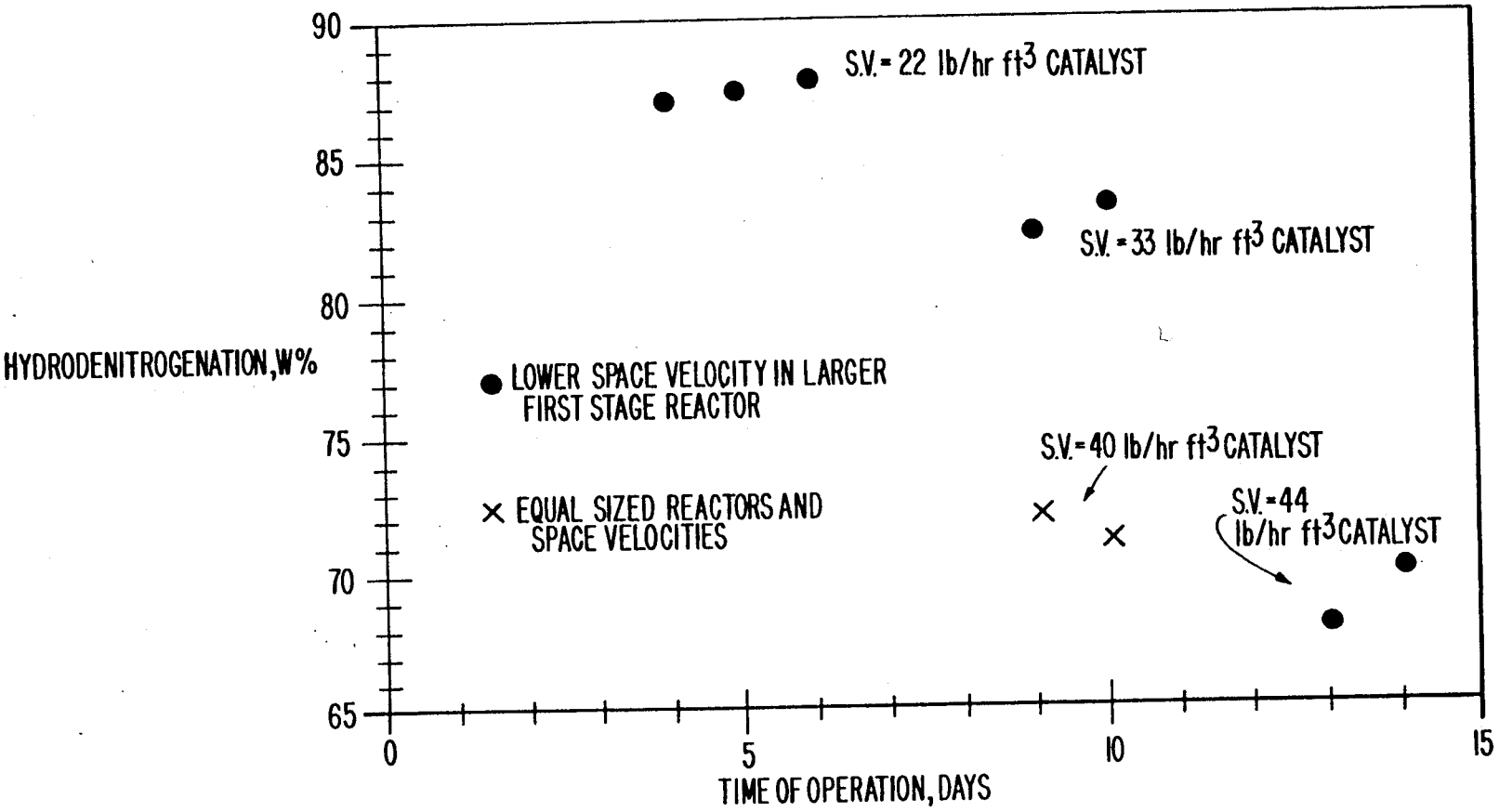
FIG. 2 is a graph showing the effect of first stage reactor lower space velocity on nitrogen removal from the coal feed.

Comparative two-stage coal liquefaction runs were made in which the first stage reactor had a larger volume and lower space velocity than for the second stage reactor. The coal feed was sub-bituminous Black Thunder-Wyoming coal and the catalyst used was Shell 317-1/32 inch dia. extrudate nickel molybdenum at reaction system pressure of 2500 psig. The catalyst had 0.75 cc/gm total pore volume with at least 25% of the pores having diameter larger than 150 Angstrom. The test conditions and results for 14-day operation are shown in the following Table 1. The effect of lower coal feed rate or space velocity in the first stage reactor on nitrogen removal percentage as compared to use of equal space velocity in each staged reactor is also shown graphically by FIG. 2.

TABLE 1

COAL LIQUEFACTION USING LARGER FIRST STAGE REACTOR VOLUME

| | CONDITION NO. | | |
|---|---|---|---|
| | 1 | 2 | 3 |
| Days of Operation | 1-6 | 7-10 | 11-14 |
| Reaction Temp. °F. | | | |
| First Stage | 750 | 750 | 750 |
| Second Stage | 800 | 825 | 825 |
| Dry Coal Feed Rate, gm/hr | 700 | 1050 | 1400 |
| Coal Space Velocity, lb/hr ft3 Catalyst Settled Volume | | | |
| First Stage | 22 | 33 | 44 |
| Second Stage | 44 | 67 | 89 |
| Denitrogenation, W % | 87.5 | 83.4 | 70.4 |

Results indicated that near equivalent conversion to distillate liquid products was achieved along with a significant improvement in nitrogen removal or denitrogenation to at least 83W %, at first stage space velocity less than about 40 lb coal/hr/ft$^3$ catalyst settled volume, as compared to only 70.4W % denitrogenation achieved for higher space velocities.

Results of further runs made at different space velocities are shown below in Table 2.

TABLE 2

EFFECT OF UNEQUAL SIZED REACTORS ON SUB-BITUMINOUS COAL

| | EQUAL SIZE | UNEQUAL SIZE |
|---|---|---|
| Bench Run No. | 1 (227-55) | 2 (227-57) |
| Period | 9-10 | 10-11 |
| Reaction Temp., °F. | | |
| First Stage | 750 | 750 |
| Second Stage | 825 | 825 |
| Space Velocity, Lb/Hr/Ft3 Catalyst | | |
| First Stage | 20 | 15 |
| Second Stage | 20 | 30 |
| Total | 10 | 10 |
| Yields, W % Dry Coal | | |
| $C_1$-$C_3$ Gas | 8.19 | 7.72 |
| $C_4$-390° F. Liquids | 20.15 | 20.45 |
| 390-650° F. Liquids | 29.18 | 29.12 |
| 650-975° F. Liquids | 14.15 | 12.65 |
| 975° F.+ Liquids | 2.56 | 1.60 |
| Unconverted Coal | 8.20 | 9.95 |
| Ash | 6.01 | 5.0 |
| $H_2O$, $NH_3$, $H_2S$, $CO_x$ | 19.34 | 20.5 |
| Total (100 Plus $H_2$) | 107.75 | 107.8 |
| Coal Conversion, W % Dry Coal | 91.2 | 89.4 |
| 975° F.+ Conversion, W % Dry Coal | 88.5 | 87.7 |
| Hydrodesulfurization, W % Dry Coal | 71.6 | 67.9 |
| Hydrodenitrogenation, W % Dry Coal | 75.7 | 83.4 |
| $C_4$-975° F. Product, W % Dry Coal | 67.5 | 66.1 |

EXAMPLE 2

Additional two-stage coal liquefaction runs were made on bituminous Illinois No. 6 coal using the same first and second stage reactor configuration as for Example 1. The catalyst used in both stage reactors was 1/32 inch diameter extrudates of Shell No. S-317 nickel molybdenum catalyst. The test conditions and results are provided in Table 3 below.

TABLE 3

EFFECT OF DOUBLED FIRST STAGE REACTOR VOLUME UPON OPERATING RESULTS

| | | | |
|---|---|---|---|
| Run No. | 227-39 | 227-37 | 227-44 |
| Period Number | 3-6 | 3-5 | 3-5 |
| Ratio First Stage/Second Stage Volume | 1/1 | 1/1 | 2/1 |
| Ash in Coal Feed, W % | 10.55 | 10.55 | 10.65 |
| Average Catalyst Age, Lb. Dry Coal/Lb | | | |
| Catalyst (Second Stage) | 118 | 102 | 103 |
| Reactor Temperatures, °F. | | | |
| First Stage | 752 | 750 | 750 |
| Second Stage | 801 | 800 | 804 |
| Unit Back Pressure, psig | 2468 | 2500 | 2481 |
| Coal Space Velocity Lb/Hr/Ft$^3$ Catalyst (Second Stage) | 42.0 | 42.1 | 41.6* |
| Total Gross Material Recovery, W % | 98.05 | 98.0 | 99.85 |
| Normalized Yields, W % MAF COAL | | | |
| $C_1$-$C_3$ Gas | 6.62 | 5.74 | 7.04 |
| $C_4$-390° F. Liquid | 19.39 | 17.10 | 21.85 |
| 390-650° F. Liquid | 40.51 | 36.85 | 45.67 |
| 650-975° F. Liquid | 10.59 | 18.7 | 8.28 |
| 975° F.+ Residual Oil | 5.95 | 5.85 | 1.20 |
| Unconverted Coal | 6.50 | 7.28 | 4.90 |
| Water | 13.50 | 10.62 | 14.27 |
| CO | 0.13 | 0.06 | 0.00 |
| $CO_2$ | 0.08 | 0.21 | 0.16 |
| $NH_3$ | 1.69 | 1.67 | 1.67 |
| $H_2S$ | 2.88 | 3.08 | 2.88 |
| Total (100 + $H_2$ Reacted) | 107.69 | 107.38 | 107.96 |
| Coal Conversion, W % MAF | 93.50 | 92.72 | 95.07 |
| 975° F. Conversion, W % MAF | 87.56 | 86.87 | 93.85 |
| Hydrogen Efficiency | 9.27 | 9.93 | 9.54 |
| $C_4$-975° F.+, W % MAF | 70.50 | 73.24 | 75.90 |
| Nitrogen Removal, W % | 86.6 | 85.1 | 93.0 |

*Space Velocity in first stage reactor is 20.8 lb/hr ft$^3$ catalyst

From the above results, it is noted that nitrogen removal for the reactor volume ratio of 2/1 with low space velocity in the first stage reactor was 93 wt %, compared to 85-86 wt % nitrogen removal for equal reactor volume and space velocities in each stage reactor.

Although this invention has been described broadly and in terms of preferred embodiments thereof, it will be understood that modifications and variations can be made to the process within the spirit and scope of the invention, which is defined by the following claims.

I claim:

1. A process for catalytic multi-stage hydrogenation of coal to produce low-boiling hydrocarbon liquid and gaseous products containing minimal nitrogen compounds, comprising:

(a) feeding particulate coal and a hydrocarbon slurrying oil at temperature below about 650° F. into a pressurized first stage catalytic reaction zone containing coal-derived liquid and hydrogen and an ebullated bed of particulate hydrogenation catalyst, said catalyst having at least about 25% of its total pore volume contained in pores having diameter larger than 150 Angstroms;

(b) passing said coal-oil slurry and hydrogen upwardly through said first stage ebullated bed of particulate catalyst, said catalyst bed being maintained at 700°-800° F. temperature, and 1500-3500 psig hydrogen partial pressure and at space velocity of 10-40 lb coal/hr ft$^3$ catalyst settled volume, so as to rapidly heat the coal and catalytically hydrogenate it and recycled solvent oil to produce a partially hydrogenated and hydroconverted coal-derived material;

(c) withdrawing said partially hydrogenated coal-derived material containing gas and liquid fractions from said first stage reaction zone, and passing said material to a second stage catalytic reaction zone together with additional hydrogen, said second stage reaction zone being maintained at 760°-870° F. temperature, 1500-3500 psig hydrogen partial pressure, and at a space velocity at least 10% greater than for said first stage reaction zone for further reacting and hydrocracking the liquid fraction material therein with minimal dehydrogenation reactions to produce gas and lower boiling hydrocarbon liquids;

(d) withdrawing from said second stage catalytic reaction zone the hydrocracked material containing hydrocarbon gas and liquid fractions, and phase separating said material into separate gas and liquid fractions;

(e) passing said liquid fraction to distillation and a liquid-solids separation steps, from which a hydrocarbon liquid stream normally boiling above about 500° F. and containing a reduced concentration of particulate solids is recycled to the coal slurrying step; and (f) recovering hydrocarbon gas and increased yields of low boiling hydrocarbon distillate liquid products having minimal nitrogen content from the process.

2. The process of claim 1, wherein the particulate hydrogenation catalyst is selected from the group consisting of cobalt, iron, molybdenum, nickel, tin, tungsten and mixtures thereof deposited on a base support material selected from the group consisting of alumina, magnesia, silica, and combinations thereof.

3. The process of claim 1, wherein the first stage reaction zone is maintained at 720°-780° F. temperature, 2000-3000 psig hydrogen partial pressure, and space velocity of 15-35 lb/hr/ft$^3$ catalyst settled volume.

4. The process of claim 1, wherein the coal space velocity in the second stage reactor is 1.1-3 times that in the first stage reactor.

5. The process of claim 1, wherein the second stage reaction zone is maintained at 780°-860° F. temperature and 2000-3000 psig hydrogen partial pressure, and space velocity of 20-70 lb coal/hr ft$^3$ catalyst settled volume.

6. The process of claim 1, wherein the first stage reaction zone contains a particulate hydrogenation catalyst comprising nickel and molybdenum on an alumina support material, said catalyst having total pore volume of 0.4-1.2 cc/gm with 30-50% of its pores having diameter of 200-2000 Angstroms.

7. The process of claim 1, wherein the second stage reaction zone contains a catalyst comprising cobalt and molybdenum on an alumina support material.

8. The process of claim 1, wherein the coal feed is bituminous type coal having nitrogen content exceeding about 1.0 wt. percent.

9. The process of claim 1, wherein the coal feed is sub-bituminous type coal having nitrogen content exceeding about 0.6 wt. percent.

10. A process for catalytic two-stage hydrogenation of coal to produce increased yields of low-boiling hydrocarbon liquid containing minimal nitrogen compounds and gaseous products, the process comprising:

(a) mixing particulate bituminous coal with sufficient coal-derived hydrocarbon liquid to provide a flowable slurry and feeding the coal-oil slurry at temperature below about 650° F. directly into a pressurized first stage catalytic reaction zone containing coal-derived liquid and hydrogen and an ebullated bed of particulate hydrogenation catalyst, said catalyst having 0.3-1.2 cc/gm total pore volume and having 25-60% of its pore volume contained in pores having diameter of 200-2000 Angstroms;

(b) passing said coal slurry and hydrogen upwardly through said first stage ebullated bed of particulate hydrogenation catalyst, said catalyst bed being maintained at 720°-790° F. temperature, 1500-3500 psig hydrogen partial pressure, and space velocity of 15-35 lb coal/hr/ft$^3$ to rapidly heat the coal and recycled solvent oil to catalytically hydrogenate it to produce a partially hydrogenated and hydroconverted coal-derived material;

(c) withdrawing said partially hydrogenated coal-derived material containing gas and liquid fractions from said first stage reaction zone, and passing said material directly to a second stage catalytic reaction zone together with additional hydrogen, said second stage reaction zone being maintained at 780°-860° F. temperature and 1500-3500 psig hydrogen partial pressure and at least 10% greater space velocity of 20-70 lb coal/hr ft$^3$ catalyst settled volume for further reacting and hydrocracking the liquid fraction material therein together with minimal dehydrogenation reactions so as to produce gas and low boiling hydrocarbon liquids;

(d) withdrawing from said second stage catalytic reaction zone the hydrocracked material containing hydrocarbon gas and liquid fractions, and phase separating said material into separate gas and liquid fractions;

(e) passing said liquid fraction to distillation steps and to a liquid-solids separation step, from which a hydrocarbon liquid stream normally boiling above about 550° F. and containing a reduced concentration of particulate solids is recycled to the coal slurrying step; and (f) recovering hydrocarbon gas and increased yields of low boiling hydrocarbon distillate liquid products having minimal nitrogen content from the process.

* * * * *